US005092084A

United States Patent [19]

Schlick

[11] Patent Number: 5,092,084

[45] Date of Patent: Mar. 3, 1992

[54] METHOD AND APPARATUS FOR REMOVING COATINGS FROM PLASTIC LAMINATES

[75] Inventor: Horst-Dieter Schlick, Metelen, Fed. Rep. of Germany

[73] Assignee: Schlick-Roto-Jet Maschinenbau GmbH, Metelen, Fed. Rep. of Germany

[21] Appl. No.: 709,501

[22] Filed: Jun. 3, 1991

Related U.S. Application Data

[63] Continuation of Ser. No. 340,057, Apr. 18, 1989, abandoned.

[30] Foreign Application Priority Data

Apr. 27, 1988 [DE] Fed. Rep. of Germany ..... 3814192

[51] Int. Cl.[5] ..... B24C 3/14

[52] U.S. Cl. ..... 51/432; 51/410; 51/320

[58] Field of Search ..... 51/432, 428, 433, 434, 51/431, 410, 320

[56] References Cited

U.S. PATENT DOCUMENTS

| | | | |
|---|---|---|---|
| 2,077,635 | 4/1937 | Minich | 51/434 |
| 2,263,321 | 11/1941 | Unger | 51/431 |
| 2,708,814 | 5/1955 | Straub | 51/432 |
| 3,936,979 | 2/1976 | Fuerst | 51/434 |

FOREIGN PATENT DOCUMENTS

| | | | |
|---|---|---|---|
| 2108022 | 5/1983 | United Kingdom | 51/434 |

*Primary Examiner*—Robert A. Rose
*Attorney, Agent, or Firm*—Felfe & Lynch

[57] ABSTRACT

Abrasive method for the removal of coatings, such as paint, decorative films, overlays and the like from plastic surfaces, especially plastic laminates. The method operates by utilizing an impeller wheel which is movable at a substantially constant distance relative to the surface of a workpiece. A stream of abrasive particles is directed against the surface, and consists of sharp-edge steel-elastic plastic granules which impact with a velocity between 25 and 100 m/s. The impeller is guided steadily in several passes over all surface areas to be treated. After each pass a visual inspection is performed. Preferably the granules have a hardness of 3–3.5 on the Mohs hardness scale.

5 Claims, 2 Drawing Sheets

METHOD AND APPARATUS FOR REMOVING COATINGS FROM PLASTIC LAMINATES

This is a continuation application of application Ser. No. 340,057, filed Apr. 18, 1989, now abandoned.

BACKGROUND OF THE INVENTION

The invention relates to an abrasive method for removing coatings, such as paint, decorative films, and overlays of plastic surfacing, especially plastic laminates. The invention furthermore relates to an apparatus for the practice of the method.

The term "plastic laminates," as used herein, refers to multilayer pieces of support materials, such as glass fiber, carbon fiber or plastic fiber fabrics which are cemented together with bonding agents (laminating resins) such as epoxy and melamine resins, thermoplastics, etc. Such laminates are used for technical purposes, especially in aircraft, motor vehicle and boat construction, but also for sporting equipment—skis, for example—and for furniture and the like. For example, the laminates consist of several layers of core film and a decorative film based on an amino plastic resin basis as the surface layer and, in some cases, a transparent or colored overlay pressed over the decorative film. The laminates are made by layering the resin-impregnated support materials.

A typical example of such laminates are helicopter rotor blades, in which the support materials are covered all the way into the outer area, with only a relatively thin coating of plastic. The cover layer in turn is covered with a coat or paint or decorative film. After a certain period of use, or also in the event of damage, the coating must be stripped from the helicopter rotor blades. Heretofore a manual method has primarily been used, i.e., using sanding blocks or abrasive sponges to rub off the surface manually until the coating is removed. Problems have arisen, due on the one hand to the heavy labor involved, and on the other hand to the health hazard constituted by the dust. Lastly, in military use problems have arisen due to the fact that the sometimes very sensitive parts are maliciously damaged and the damage can hardly be detected.

Attempts have therefore already been made to perform an abrasive treatment with abrasive particles fed in a known manner by means of a compressed air hose and a nozzle and driven against the surface. It has been found, however, that such an abrasive method is not easy to perform, and that the accompanying air does not accurately control the amount of the particles, so that erosion and damage to the support material in the laminate occur, because the surface is removed too rapidly.

The problem therefore arises of devising an abrasive method which will leave the very sensitive plastic laminates unharmed and will nevertheless permit the gentle removal of coatings of the kind described above, so that the disadvantages cited above will not be incurred. The method is furthermore to be easy to automate, so that it will not involve a great number of personnel.

SUMMARY OF THE INVENTION

This problem is solved by a method which operates by means of a centrifugal impeller which can be moved at a substantially constant distance from the plastic surface that is to be cleaned, while a jet of abrasive grit particles consisting of sharp-edged, steel-elastic plastic granules is directed against the surface, impacting the latter with a velocity between 25 and 100 m/s, the impeller being guided steadily and in a plurality of passes over all of the surface areas to be treated, and a visual inspection being performed after each pass. At the same time the possibility is offered of moving the impeller and keeping the surface at rest or, vice-versa, of moving the workpiece past one or more impellers.

Centrifugal impellers by which abrasive particles can be driven against a surface are known. However, a very precise analysis of the surface to be treated and of the substance to be removed had to be performed in order to discover the correct procedure and the correct parameters of the abrasive method of the invention. In particular, it was found to be important to use an impeller for the purpose of minimizing the volume of blast air and entrained air which inevitably occur in cleaning with a compressed air device. The abrasive grit particles consist of "steel-elastic plastic granules." This refers to the property whereby the plastic granules obey Hooke's law in their elasticity. The shear modulus should not be less than $10^2$ kp/cm$^2$ (1 kp=9.80665 Newton). Thermosets are therefore primarily suited as granules, in which a relatively low blast temperature, preferably room temperature of 20° C. should not be exceeded. It will therefore be necessary in many cases to re-cool the granules regularly. Since the surface coating and the laminate beneath it often enter into a very tight bond, it is necessary always to remove only a relatively thin layer in one pass. In each repeated pass, therefore, it will be necessary to examine whether any coating remains which is still to be removed.

It has been found that granules of thermosetting plastics can preferentially be used which have a mesh size between 0.2 and 1.5 mm. The hardness should be between 3 and 3.5 on the Mohs hardness scale. Broken plastic scrap material from injection molding rejects or press rejects is outstandingly suitable.

The impact angle of the granules when blasted should be between 30° and 90° to the surface of the workpiece. To minimize entrained air the grits are delivered to the impeller only by free fall or through chutes.

A device for the practice of the method comprises a housing, a motor with drive shaft, a grit feed duct terminating on the side of the housing opposite the drive shaft, and an impeller disposed in the housing and mounted on the drive shaft and rotating about an end of the feed duct in the vicinity of the hub of the drive shaft. The device is characterized by the fact that the end of the feed line is a stationary guiding tube which has in its periphery an opening for the discharge of the grits and is surrounded with a close fit by the rotating impeller such that any entrained air except air drawn through the window of the guiding tube into the impeller wheel is substantially blocked.

Preferably the guiding tube with the window is adjustable by rotation so that different angles of impact can be set. Lastly, it is also advantageous if the grits feed line terminates in a feed connection centered on the guiding tube, which has a diameter smaller than that of the guiding tube, and in which air intake openings are disposed outside of the periphery of the feed connection and lead into the guiding tube. The ejection of the grits produces a certain vacuum in the end piece, which requires a constant inflow of air. This inflow, however, should mix with or affect the granules as little as possible. Therefore this inflow air is fed in outside of the end piece of the feed connection.

It is furthermore advantageous if the inlet cross section of the air openings is variable so that only a minimum of inflow air is produced.

In accordance with the invention, a method for abrasively removing coatings from plastic surfaces comprises utilizing a centrifugal impeller wheel which can be moved relative to a surface at a substantially constant distance therefrom, to direct a blast of abrasive particles at the surface and consisting of sharp-edged, steel-elastic plastic granules which impinge at a velocity between 25 and 100 m/s. The method includes guiding the impeller wheel steadily and in several passes over all surface areas that are to be treated and performing a visual inspection after each pass.

Also in accordance with the invention, an impeller wheel device comprises an impeller housing and a motor for driving the impeller wheel. The device includes a drive shaft for an impeller and having a hub. The device also includes a grit feed line which terminates on a side of the housing opposite the drive shaft for the impeller. The feed line has an end in the vicinity of the hub. The device also includes an impeller disposed in the housing on the drive shaft, which rotates around an end of the feed line. The device also includes a stationary guiding tube disposed concentrically to the axis of rotation of the impeller, which has in its periphery a window for the discharge of the abrasive grits and is adjustable with the window by rotation. Air enters into the impeller through the window of the guiding tube. The device also includes a feed connection centered on the guiding tube and the grit feed line terminates in the feed connection. The feed connection has a diameter smaller than that of the guiding tube and has air recess openings disposed outside of the periphery of the feed line and leading into the guiding tube.

For a better understanding of the invention, together with other and further objects thereof, reference is made to the following description, taken in connection with the accompanying drawings, and its scope will be pointed out in the appended claims.

BRIEF DESCRIPTION OF THE DRAWINGS

Referring now to the drawings.

DESCRIPTION OF A PREFERRED EMBODIMENT

Figure 1:
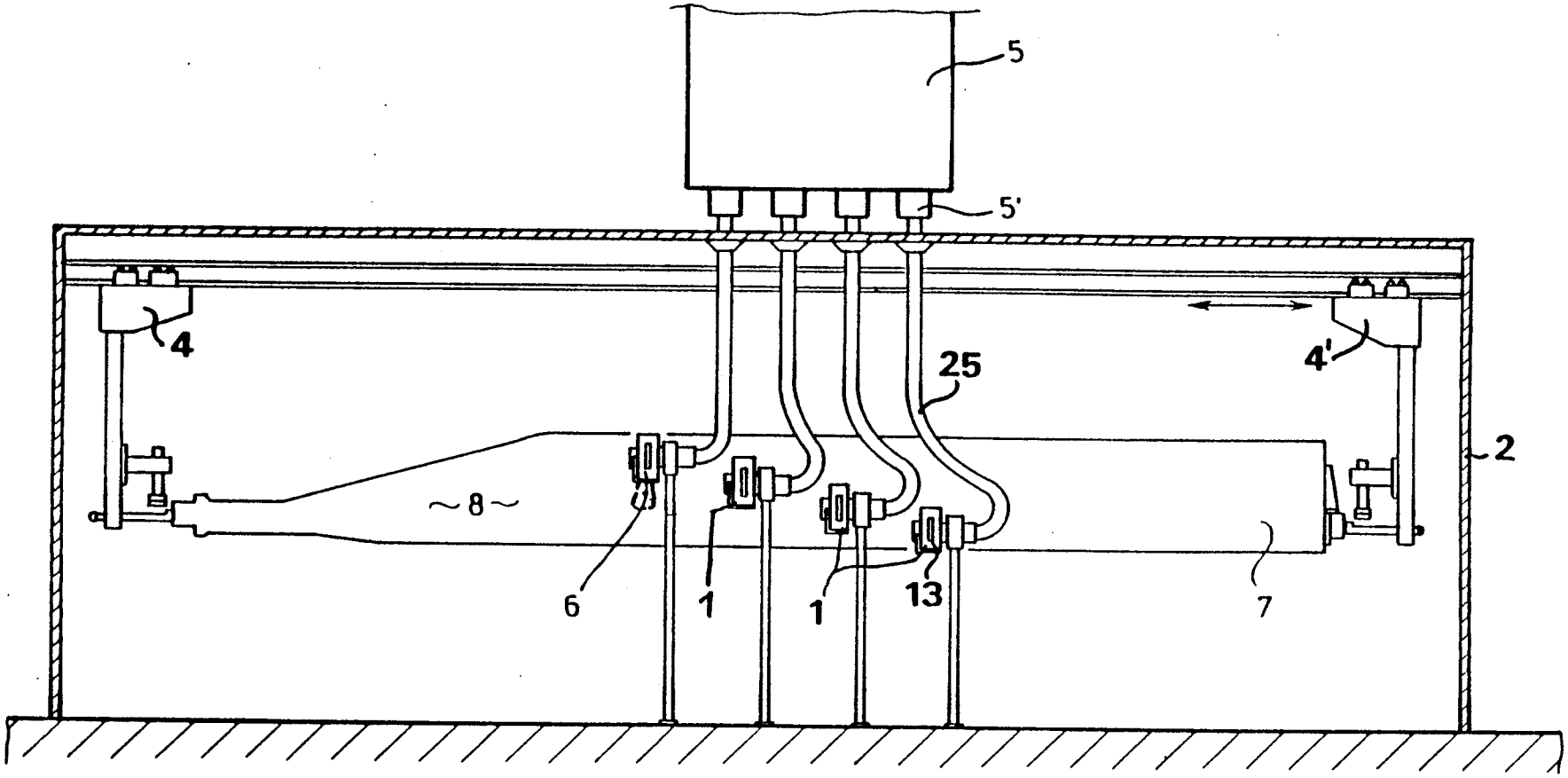
FIG. 1 is a sectional view of blasting enclosure with a plurality of devices for the practice of the method.

The method in accordance with the invention preferably is practiced by means of several blasting devices 1. The blasting devices in the present embodiment preferably are disposed in a staggered relationship and preferably are adjustable in height according to the object that is to be cleaned in a blasting enclosure 2. Between the blasting devices which are situated opposite one another in pairs is an alley in which the workpiece 7 can be carried for cleaning. For this purpose it is suspended from trolleys 4, 4', which travel on a rail in the roof of the enclosure 2. Above the enclosure 2 there is placed a reservoir 5 containing blasting grits, from which the abrasive grits fall freely through the feed line into the blasting device 1. No additional conveyor means is provided to carry the grits from the supply container to the blasting device.

Each blasting device 1 is provided with a centrifugal impeller (cf. FIG. 2) which directs a stream 6 of abrasive grits against the surface 8 of the workpiece 7. The workpiece 7 is a helicopter rotor of plastic laminate, a boat hull, or the like. The workpiece preferably is carried along by means of the suspension and the trolleys at a substantially constant distance past the staggered array of blasting devices 1. This can be done either through a variable means for controlling the trolleys 4 or else by an operator (not shown) who guides the hanging workpiece. The angle which the impacting grits form with the surface of the workpiece is between about 30° and 90° . The workpiece is carried past the blasting devices 1 preferably pointing at different angles.

The stream 6 of abrasive grits preferably consists of sharp-edged, steel-elastic plastic granules. The circumferential velocity of the impeller 10 is made such that the impact velocity at a relatively close distance between the blasting device 1 and the surface 8 preferably amounts to between 25 and 180 m/s. In general, a distance between the workpiece surface 8 and the axle of the impeller 10 of 2 to 4 D (D=diameter of impeller) preferably is maintained. The throughput of the grits is approximately 3 kg of grits per killowatt of installed impeller driving power.

The workpiece is moved steadily past the blasting devices 1 with the impeller wheels 10. Each of the areas of the surface that is to be treated is swept several times. After each pass a visual inspection is performed, to determine whether any coating remains that must still be removed by another pass. Individual impellers can be stopped or their feed of grits can be shut off briefly by shutting their cone valves 5'.

The workpieces 7 may consist of plastic laminate which has been described above. Such laminates are relatively soft and require careful handling so as to prevent erosion and damage of the support material, such as an aramid fiber fabric, for example. Consequently the selection of the abrasive grits is important. In the present case plastic granules have been selected which, being thermosets, preferably have a hardness of 3 to 3.5 on the Mohs hardness scale and preferably have a grit size between 0.2 and 1.5 mm. The granules are made preferably from metal-free, broken, plastic product material. In other words it does not have to be an expensive recycling material. The important thing is that harder components than the thermoset granules be excluded. In particular, metal and sand should be avoided.

Figure 2:
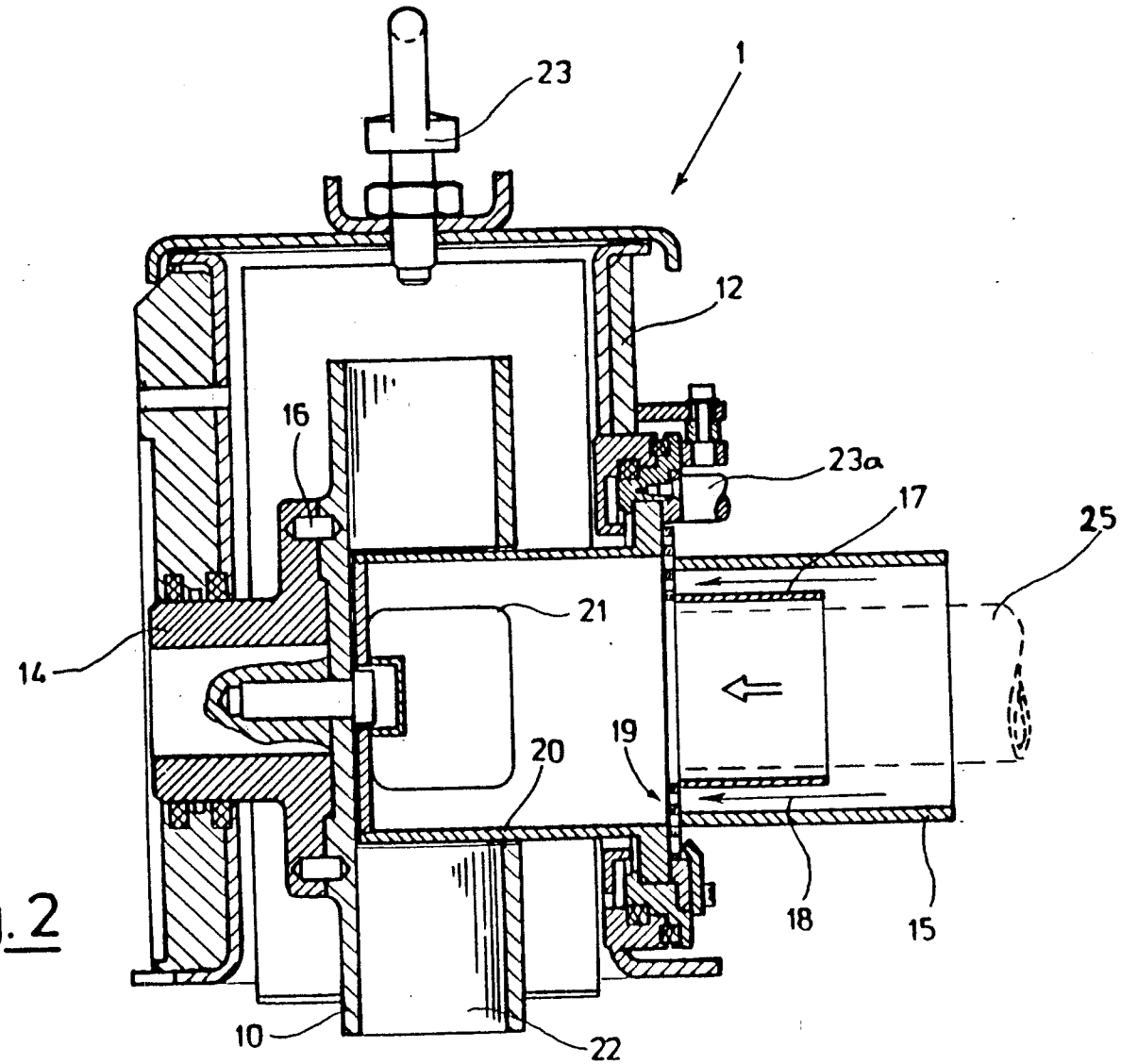
FIG. 2 is a sectional view of a blasting device.

For the practice of the method a specially designed blasting device in accordance with FIG. 2 is used. FIG. 2 is an enlarged section through the apparatus of FIG. 1. The device 1 comprises a housing 12 to which a drive motor 13 (not shown in FIG. 2) is flange-mounted, and a drive shaft 14. The grit feed duct 25 enters opposite the drive shaft 14 within a protective sleeve 15. Inside of the housing 12 the impeller wheel 10 is flange mounted on the drive shaft 14, using threaded studs 16 in the usual manner.

The grit feed line 25 leads into a feed connection 17 leaving an annular gap 18 between its exterior and the inside of the protective sleeve 15. This area is filled with air inlet openings 19 of adjustable cross section. The feed connection 17 and the air inlet openings 19 open into a stationary guiding tube 20 which is concentric with the axis 1 of rotation of the impeller 10. It has a close fit in the impeller. This close fit is chosen so that only grits and a minimum of air can pass through a window 21. Outside of the window 21, no air is to enter into the chambers of the impeller, especially air from outside of the guiding tube. Since a minimum of air is used, the stream of grits 6 remains largely undisturbed and can be directed against the surface at a very precise, adjustable impact angle and at a largely precisely controllable impact velocity. The impeller is provided as usual with six to eight vanes 22 for this purpose. The guiding tube 20 with the window 21 can be adjusted by means of an adjusting shaft 23*a* and a corresponding gear drive so that the impact direction of the blasting device can be adjusted. Furthermore, at least one hook 23 is fastened to the top of the housing 12.

Abrasive grits fall on the floor of the blasting enclosure, which in turn can be equipped in a known manner with a grille where the grits collect and can be carried away by known conveyor means. Then the grits preferably are cleaned and recycled to the grit supply hopper 5. The special nature of the suspension and of the guiding of the movements of the blasting device in accordance with FIG. 1 can, of course, be modified. An important thing is that the active impeller 10 can travel across the workpiece at a substantially constant distance from the surface and that the workpiece itself can be inspected by persons or by optical systems.

At the same time the impeller or impellers can be movable relative to the surface or the surface relative to the impeller.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Apparatus for practicing the method for abrasively removing coatings from plastic surfaces comprising utilizing a centrifugal impeller wheel which can be moved relative to a surface at a substantially constant distance therefrom, to direct a blast of abrasive particles at the surface and consisting of sharp-edged, steel-elastic plastic granules which impinge at a velocity between 25 and 100 m/s, guiding the impeller wheel steadily and in several passes over all surface areas that are to be treated, and performing a visual inspection after each pass, the apparatus comprising:

a housing, a motor coupled to a drive shaft having a hub, an abrasive grits feed line having an end which terminates at a side of the housing opposite the drive shaft, an impeller wheel disposed in the housing on the hub of the drive shaft, the end of the feed line being situated in the vicinity of the hub, the drive shaft rotating with respect to the end of the feed line, a stationary guiding tube disposed adjacent the end of the feed line and disposed concentrically with the axis of rotation of the impeller and having in its periphery a window for the exit of the abrasive grits, and the guiding tube being surrounded with a close fit by the rotating impeller such that the entry of air into the impeller other than through the window of the guiding tube is substantially prevented;

a feed connection centered on the guiding tube and the grits feed line terminating in the feed connection, a protective sleeve surrounding the feed connection, the feed connection having a diameter smaller than that of the guiding tube and having air access openings disposed outside of the periphery of the feed line and leading into the guiding tube, said air access openings being in direct communication with ambient air by way of the protective sleeve, allowing the impeller to draw air into the stationary guiding tube only through said access openings.

2. Apparatus in accordance with claim 1, in which the guiding tube with the window is adjustable by rotation.

3. Apparatus in accordance with claim 2, characterized in that an inlet cross section of the air access openings is variable.

4. Impeller wheel device comprising:

an impeller housing, a motor for driving the impeller wheel, a drive shaft for an impeller and having a hub, a grit feed line which terminates on a side of the housing opposite the drive shaft for the impeller, the feed line having an end in the vicinity of the hub, an impeller disposed in the housing on the drive shaft, which rotates around an end of the feed line, and a stationary guiding tube disposed concentrically to the axis of rotation of the impeller, which has in its periphery a window for the discharge of abrasive grits and is adjustable with the window by rotation, air entering into the impeller through the window of the guiding tube, a feed connection centered on the guiding tube and the grit feed line terminating in the feed connection, a protective sleeve surrounding the feed connection, the feed connection having a diameter smaller than that of the guiding tube and having air access openings disposed outside of the periphery of the feed line and leading into the guiding tube, said air access openings being in direct communication with ambient air by way of the protective sleeve, allowing the impeller to draw air into the stationary guiding tube only through said access openings.

5. Apparatus in accordance with claim 4, the air access openings have an inlet cross section that is variable.

* * * * *